US005121367A

United States Patent [19]

Rose

[11] Patent Number: 5,121,367

[45] Date of Patent: Jun. 9, 1992

[54] GAME TRAIL MONITORING DEVICE

[76] Inventor: Michael Rose, P.O. Box 186, East Holden, Me. 04429

[21] Appl. No.: 335,860

[22] Filed: Apr. 10, 1989

[51] Int. Cl.[5] ..... G04F 8/00; G04B 47/00

[52] U.S. Cl. ..... 368/1; 368/10; 368/110

[58] Field of Search ..... 368/1, 3, 10, 107-113

[56] References Cited

U.S. PATENT DOCUMENTS 4,615,624 10/1986 Goodrich ..... 368/1
4,748,601 5/1988 Reidt et al. ..... 368/1

OTHER PUBLICATIONS

Trail Timer sold by Trail Timer of St. Paul, Minn. and described on both surfaces of the card on which the device was secured.

*Primary Examiner*—Vit W. Miska

[57] ABSTRACT

A device for monitoring the passage of a big game animal along a game trail has a battery powered, digital clock within a container with the container wall provided with a telephone type of jack which includes a pull pin holding switch contacts apart to maintain the clock in operation. A trip line is connected to the pull pin and exerts a direct pull thereon when engaged by a passing animal with the position of the pulled free pin indicating the direction in which the animal was travelling.

5 Claims, 1 Drawing Sheet

GAME TRAIL MONITORING DEVICE

BACKGROUND OF THE INVENTION

For many years, birds and animals have operated unattended cameras by means of trip lines.

It is, of course, well known that such big game animals as deer follow established game trails and a recent development of interest to hunters recognized that a trip line could as well be used to interrupt the operation of a battery operated, digital electric clock and thus provide accurate information of the time a deer came along the trail. The trail was perhaps chosen because of nearby evidence such as tracks, pawings and rubbings providing evidence that the deer was a large buck.

The small and inexpensive electric clocks, otherwise well suited for such a use, require that their circuitry be modified by the addition of leads which, when connected, will stop the clock. In the above referred to development, the switch means employed to control the added leads had to respond to an indirect pull as it was a flexible and somewhat resilient member anchored at one end in the device with its other end seated between the contacts of the leads. The intermediate portion of the member was exposed as a bow to which the trip thread was attached. Furthermore, no means were provided to provide a reliable indication of the direction in which the tripping animal was travelling.

THE PRESENT INVENTION

The objective of the present invention is to provide a trail monitoring device which is positive in its operation and provides a reliable clue as to the direction in which the animal, causing its operation, was travelling.

In accordance with the invention, this objective is attained by connecting the control leads, added to the circuitry of a battery powered, digital clock, to a telephone type jack as a switch which includes a pull or trip pin to which the trip line anchored across the game trail is connected. A passing big game animal, engaging the trip line, exerts a direct pull on the pin adequate to ensure its withdrawal thus to establish a switch position in which the clock is stopped. As the container holding the clock is tied to a tree, it is free to turn slightly so that the tripping pull is exerted directly on the trip pin and the pulled free trip pin lands on the ground at the uptrail side of the original position of the trip line, holding the trip line where it landed and itself providing a positive clue as to the direction in which the tripping animal was proceeding.

Other objectives of the invention and the manner in which they are attained will be apparent from the accompanying drawings, specification, and appended claims.

BRIEF DESCRIPTION OF THE DRAWINGS

The accompanying drawings illustrate a game trail monitoring device in accordance with a preferred embodiment of the invention of which

THE PREFERRED EMBODIMENT

Figure 1:
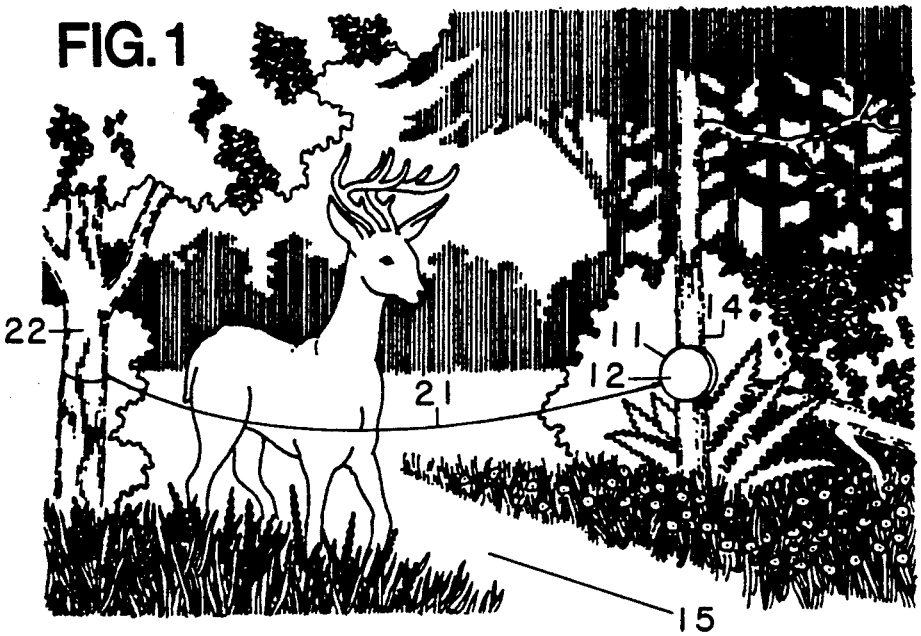
FIG. 1 is a view of a game trail with the device installed.
Figure 2:
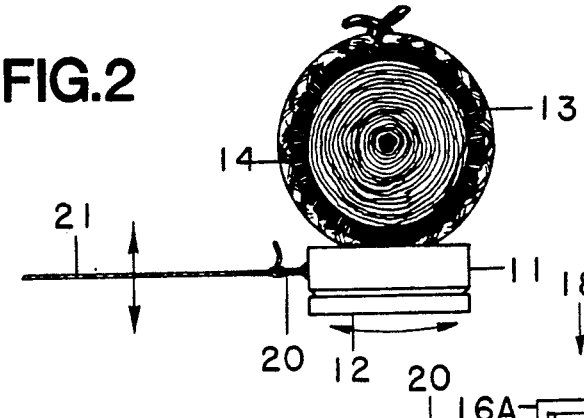
FIG. 2 is a plan view, on an increase in scale, of the container, in which the clock is detachably held, showing the container connected to a tree.

The game trail monitoring device illustrated by the drawings utilizes a battery operated clock, generally indicated at 10 confined in a watertight container 11 having a removeable cover 12. The clock 10 records AM and PM times. The container is provided with a line 13, preferably Dacron or Nylon, the ends of which are to be tied together about an anchor, usually about a tree 14 at one side of the trail to be monitored. The trail is generally indicated at 15.

Figure 4:
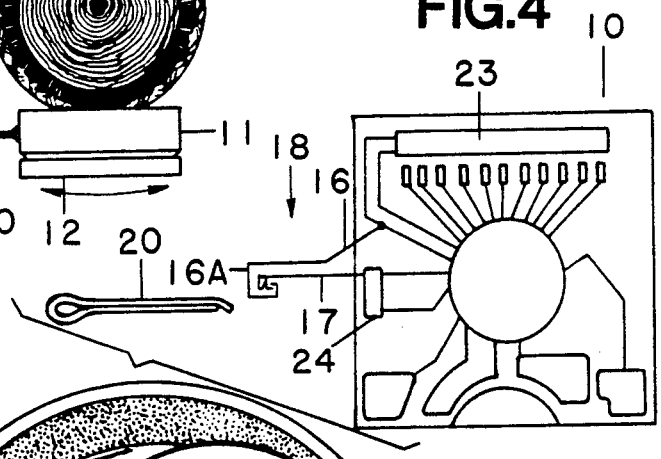
FIG. 4 is a schematic view of the switch and the clock circuit components connected thereby when the trip pin is pulled from the container.
Figure 3:
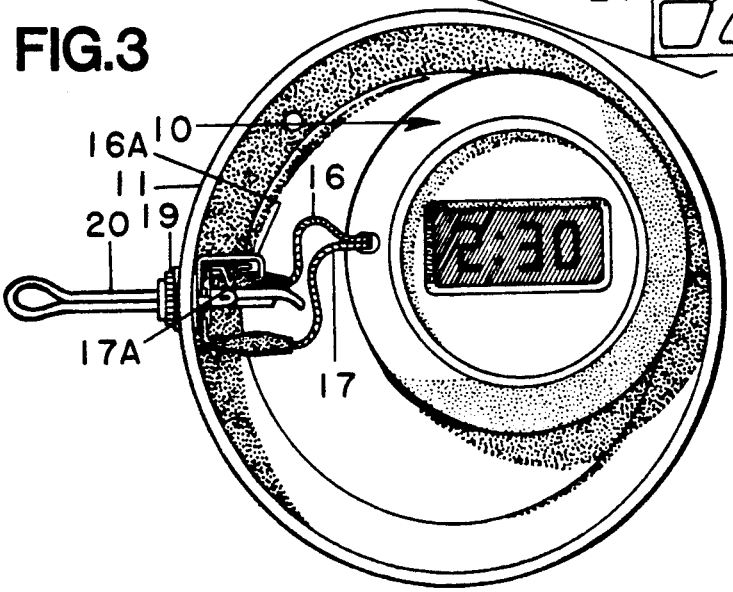
FIG. 3 is a plan view, on a further increase in scale, of the container with its cover removed.

As the clock is of a conventional, inexpensive, battery operated digital type, it is not detailed except, see FIG. 4, as to the added leads 16 and 17 and the normally open switch, generally indicated at 18, by which the clock is stopped when the switch is closed. The clock 10 is manufactured for and distributed by Dig-Time, West Hempstead, N.Y. as MC-4.

The wall of the container 11 has a port closed by the seal 19 of the switch 18 which is a telephone type of jack. The switch 18 includes a pull or trip pin 20 which may be and is shown as a cotter pin extending through and frictionally held by the seal 19. The cotter pin has an eye at its outer end to which a trip line 21, in practise monofilament of a 6–8 pound test, is attached while its other end is so formed to enable it to be easily entered through the hole in the center of the seal 19 in which the pull pin is a friction fit. The trip line 21 is long enough to extend across the trail and there to be tied to an anchor such as the tree 22.

As shown in FIG. 4, the lead 16 is connected to a capacitor 23 of the clock circuitry and the lead 17 is connected to a resistor 24 thereof of the bar type. The trip pin 20, insulated from the container and the contact of the lead 16A by the seal 18, holds the resiliently biased contact 17A of the lead 17 in an inoperative position relative to the contact 16A. It will be seen from FIG. 4 that the pull pin 20 has relatively long, sliding engagement with the contacts 16A and 17A.

The use and operation of a trail monitoring device in accordance with the invention requires a selection of a game trail which, for example, is known to be used by a trophy buck. A site is chosen along the trail for the installation of the game trail monitor. Such an installation requires only that the clock container 11 be held in place by tying the cord 13 about a tree or other anchors with the clock in operation and with the correct time set. The free end of the trip line 21 is tied about a tree or other anchor on the opposite side of the trail. Both lines are tied in positions holding the trip line above the trail a distance such that it would not be engaged by small animals, in practise, the distance is in the one to two foot range.

The trail monitor should be inspected each day and should the clock 10 be stopped, the trip pin 20 is reinserted to start the clock to show the time at which it was stopped. The clock must, of course then be reset.

In addition to enabling the time the animal passed to be learned, it should be noted that, while the lay or the trip cord 21 often indicates the animal's direction, the position of the pull pin 20 relative to the container 11 and the trees 14 and 22 is a more reliable direction indicator and it also serves to hold the trip line in its tripped position.

I claim:

1. A game trail monitoring device, said device including a container to be anchored at one side of the trail at a selected height, a battery operated timer within the container the circuitry of which includes a switch provided with first and second contacts and a trip or pull pin having first and second end portions, the first end portion normally within the container and establishing a first switch position in which the timer operates, the trip pin slidable relative to the container with said second end exposed, a trip line connected to the second end portion and of a length such that it can extend across and be anchored at the opposite side of the trail at a selected height so that, with the device installed, a big game animal engaging the trip line will cause said trip line to exert a direct pull on the pull pin pulling it free from the container to establish a second switch position in which the operation of the timer is halted and with the position of the freed pull pin relative to its initial position and that of the trip line indicating the direction the tripping animal was proceeding.

2. The game trail monitoring device of claim 1 in which the trip line is monofilament of at least 6 pounds test.

3. The game trail monitoring device of claim 1 in which the switch is of a telephone jack type and the pull pin is insulated from the container and from one of the contacts.

4. The game trail monitoring device of claim 1 in which the pull pin is frictionally held by the switch.

5. The game trail monitoring device of claim 1 in which the pull pin holds the switch contacts apart and is in engagement therewith during a substantial portion of its travel when being withdrawn.

* * * * *